United States Patent [19]

Magel

[11] 4,100,725

[45] Jul. 18, 1978

[54] YARN HAVING ALTERNATING ENTANGLED AND UNENTANGLED LENGTHS

[75] Inventor: Bernard Magel, Wilmington, Del.

[73] Assignee: E. I. Du Pont de Nemours and Company, Wilmington, Del.

[21] Appl. No.: 725,017

[22] Filed: Sep. 20, 1976

Related U.S. Application Data

[63] Continuation-in-part of Ser. No. 599,144, Jul. 25, 1975, abandoned, and a continuation-in-part of Ser. No. 708,209, Jul. 23, 1976, abandoned.

[51] Int. Cl.[2] ..... D02G 3/22; D02G 3/34

[52] U.S. Cl. ..... 57/140 J; 28/276; 57/140 BY; 57/157 F; 428/399

[58] Field of Search ..... 57/140 J, 34 B, 157 F, 57/157 TS, 140 R, 140 BY; 28/1.4, 72.14, 276; 428/373, 374, 397, 399

[56] References Cited

U.S. PATENT DOCUMENTS

| | | | |
|---|---|---|---|
| 2,852,906 | 9/1958 | Breen | 57/157 F X |
| 2,985,995 | 5/1961 | Bunting, Jr. et al. | 57/140 R |
| 3,083,523 | 4/1963 | Dahlstrom et al. | 57/34 B X |
| 3,117,367 | 1/1964 | Breen | 57/140 BY |
| 3,225,534 | 12/1965 | Knospe | 57/140 R |
| 3,286,321 | 11/1966 | Fletcher et al. | 57/157 F X |
| 3,364,537 | 1/1968 | Bunting, Jr. et al. | 57/34 B X |
| 3,416,302 | 12/1968 | Knospe | 57/140 R |
| 3,417,445 | 12/1968 | Gemeinhardt | 28/276 |
| 3,426,406 | 2/1969 | McCutchan, Jr. | 28/276 |
| 3,529,413 | 9/1970 | Marrinan et al. | 57/140 R |
| 3,563,021 | 2/1971 | Gray | 57/140 R |
| 3,593,513 | 7/1971 | Reese | 57/140 BY |
| 3,681,910 | 8/1972 | Reese | 57/140 BY |
| 3,691,750 | 9/1972 | Waters | 57/140 BY |
| 3,846,968 | 11/1974 | Sheehan et al. | 57/140 J |
| 3,946,548 | 3/1976 | Hino et al. | 57/140 J |
| 3,994,121 | 11/1976 | Adams | 57/157 TS X |

FOREIGN PATENT DOCUMENTS

| | | |
|---|---|---|
| 1,117,502 | 6/1968 | United Kingdom. |

*Primary Examiner*—John Petrakes

[57] ABSTRACT

A yarn is provided which has zero twist and random lengths of tightly entangled fibers as nodes having substantially zero twist and comprising an average of about 20%–70% of a representative length of yarn, said nodes having a retentivity of at least 75% and alternating with random lengths of substantially unentangled asymmetrically splayed fibers in intervals having an average length of about 3–12 mm. A fraction of the fibers in the yarn can be broken to provide effect yarns.

33 Claims, 8 Drawing Figures

YARN HAVING ALTERNATING ENTANGLED AND UNENTANGLED LENGTHS

CROSS REFERENCE TO RELATED APPLICATION

This application is a continuation-in-part of application Ser. No. 599,144, filed July 25, 1975, and of application Ser. No. 708,209, filed July 23, 1976, both now abandoned.

BACKGROUND OF THE INVENTION

This invention relates to substantially zero twist yarns which can be used in conventional weaving and knitting operations to produce fabrics having improved tactile and visual aesthetics.

Before being knitted or woven, zero twist textile yarns are inevitably subjected to one or more processing steps in order to improve their handling properties. At the very least, true textile twist at the "producer" level of twist (normally less than 0.4 turns/cm) is needed merely to allow such yarn to be withdrawn from its supply package and for some purposes very high levels of twist are required, i.e., from 6–12 turns/cm. The need for such twist or a replacement therefor is described by Bunting, Jr. et al. in U.S. Pat. No. 2,985,995.

In addition, zero twist yarns are often processed before they are knitted or woven to improve aesthetics potential for the fabric to be produced from such yarns. Generally, procedures such as stuffer box crimping, jet screen bulking, false twist set texturing and the like are conventionally employed. Indeed, false twist set textured yarns composed of polyester, nylon and the like have found widespread acceptance in woven and knitted fabrics. However, such fabrics, particularly knits, tend to snag and have air permeabilities lower than optimum for summer wear. On the other hand, fabrics made from yarns which are not processed or textured tend to have a sleazy or synthetic hand and a glitter that is also undesirable.

SUMMARY OF THE INVENTION

A yarn which has a unique structure and which can be easily processed into fabrics having a dry hand, flowing drape, appealing luster and good air permeability has been found. The yarn has substantially zero twist and random lengths of tightly entangled fibers as nodes having zero twist and comprising an average of about 20%–70% of a representative length of the yarn, said nodes having a retentivity of at least 75% and alternating with random lengths of substantially unentangled asymmetrically splayed fibers in intervals having an average length of about 3–12 mm. Continuous filament yarns are hereinafter referred to as modified yarns. A fraction of the filaments in the yarn can be broken to produce effect yarns which have enhanced spun-like aesthetics. As used herein, the term fiber is generic to continuous filaments and discontinuous or broken filaments in the yarn and, unless otherwise indicated, discussion of a yarn of this invention is generic to modified and effect yarns.

DRAWINGS

Figure 7:
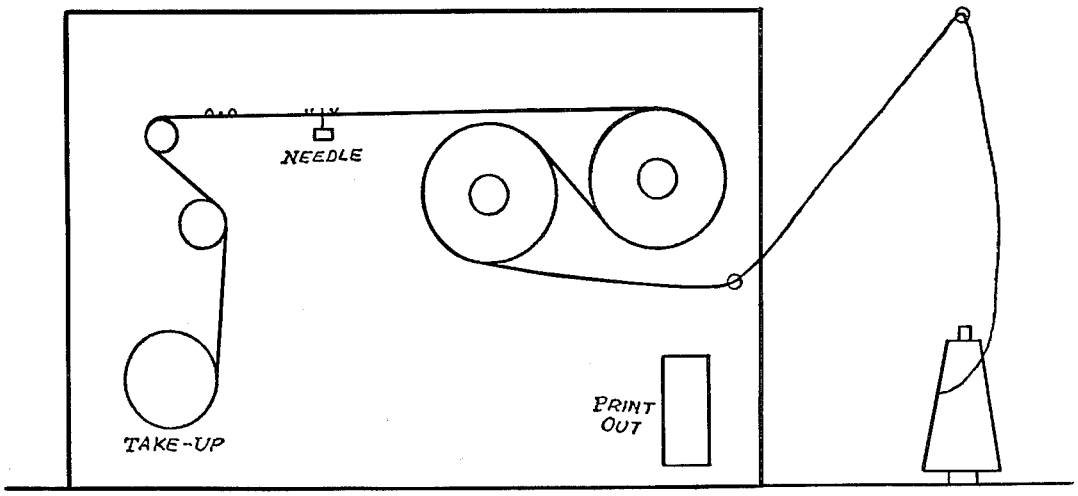
Figure 6:
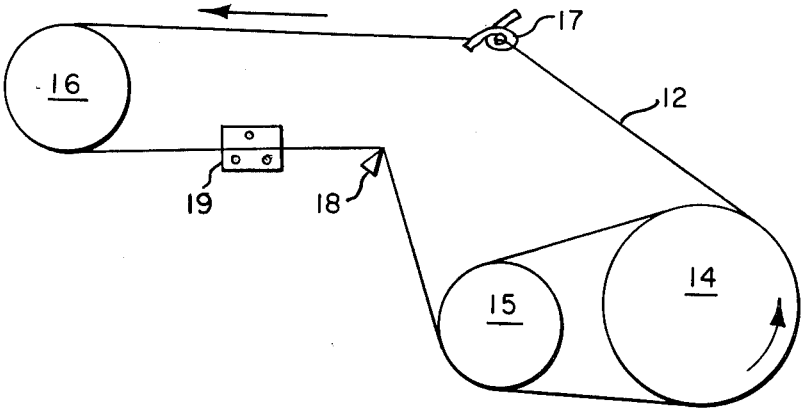

FIG. 6 schematically illustrates the apparatus used to measure node retentivity;

FIG. 7 is a schematic diagram of a Rothschild Yarn Entanglement Tester; and

Figure 8:
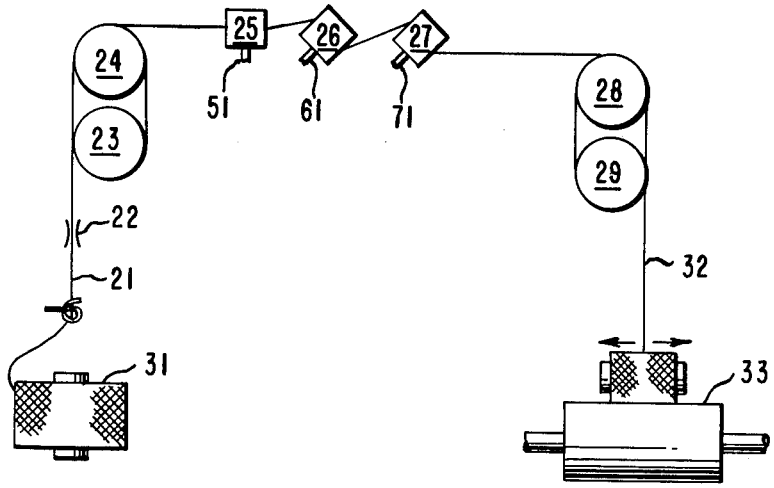

FIG. 8 is a schematic diagram of another process used to prepare the yarns of this invention.

DETAILED DESCRIPTION OF THE INVENTION

Figure 1:
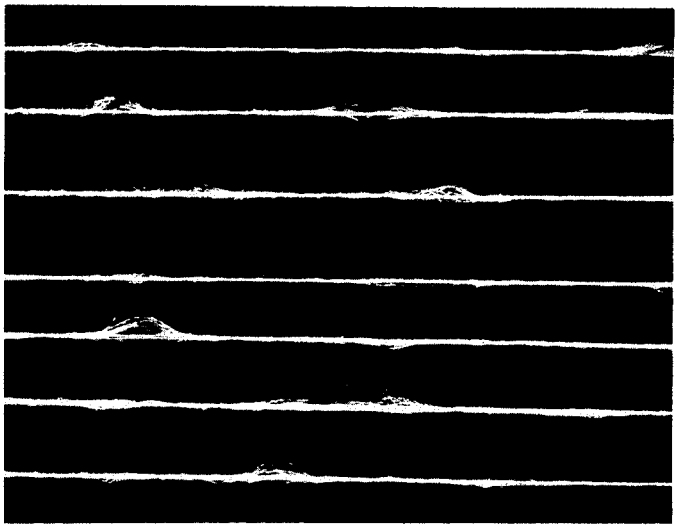
FIG. 1 is an optical micrograph of a modified yarn magnified 3.5X.

The yarns of this invention are particularly useful in making woven or knitted apparel or home furnishing fabrics, e.g., dresswear, blouses, sheets, toweling, draperies, curtains and the like. The structure characteristic of the yarns of this invention serves as a twist substitute because of the yarn morphology as illustrated in FIG. 1. Thus, fabrics can be produced from the yarns of this invention which are similar to those made from twisted yarns, for curtains, for example, without the expense of the twisting step otherwise required to consolidate a yarn and confer frictional characteristics. As FIG. 1 shows, the modified yarns are characterized by nodes or intensely entangled segments alternating with intervals or segments containing substantially unentangled asymmetrically splayed filaments. The nodes and intervals have sufficiently random lengths that fabric features attributable thereto, including spun-like aesthetics, are not accompanied by objectionable barre patterning.

Figure 2:
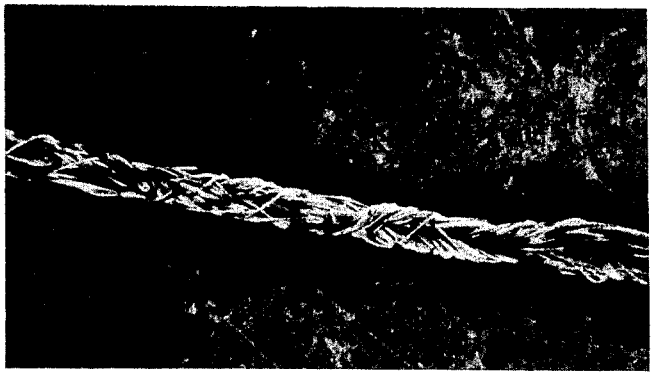
FIG. 2 is an electron micrograph of a node that has been vapor-metallized and magnified 24X to show morphological details.

The nodes in the structure of the yarns of this invention are intensely entangled and, upon microscopic examination, preferred node structures appear to have a predominantly (greater than about 50%) tightly braided appearance as shown in FIG. 2. Most preferably, the node structures are substantially all (90% or more) braided in appearance. The cross-section of such nodes is essentially round or occasionally elliptical in shape. The nodes may have any other form as desired as long as they are tightly entangled. By tightly entangled is meant that the entanglement in the node is so intense that the nodes will have a retentivity of at least 75%. By retentivity is meant the percentage of the original node length retained after the yarn undergoes the Dynamic Stability Test described herein. The dynamic stability test applies about the same amount of force to a yarn as the yarn experiences transiently when it is being woven conventionally, except that the test requires this force to be maintained on the yarn for thirty seconds. In order to insure that the integrity of the yarn is maintained through processing, the retentivity of the highly entangled lengths is preferably at least 95%. It is not uncommon to find individual yarns that have substantially the same average length of entangled segments after textile processing into and removal from, knitted or woven fabrics.

Figure 3:
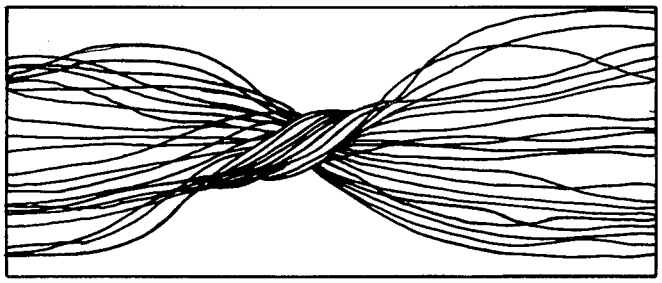
FIG. 3 depicts an idealized false twist knot.

Since nodes are sufficiently devoid of false twist knots to have substantially zero twist in the node structure and since yarn of this invention, as produced, has substantially zero twist along its length, the yarn is torque free and devoid of twist liveliness. Accordingly, the yarn presents no torque balancing problem in knitting. Further, because the nodes have zero twist, the yarn does not tend to bend in any plane as could the false twist knots shown in FIG. 3. Accordingly, fabric aesthetics are different. In addition, the zero twist nodes do not develop unbalanced shear stresses in their cross sections which in turn can cause torsional buckling, — a kind of yarn deformation encountered with twisted or possibly false twist knotted yarns when the yarn crowns to release torsional energy.

The nodes comprise a minimum of about 20% of a representative length of yarn of the invention which is generally a randomly chosen length of at least one meter. Preferably, the nodes comprise at least 30% of the yarn length to provide a definite distinctiveness to fabrics compared to fabrics prepared from the unmodified feed yarn. A desirable maximum is about 70%, preferably 60% of nodes in a representative yarn length since higher amounts result in stiff yarns which provide fabrics with a harsh, sometimes scratchy tactility. As long as these ranges are observed, the length of each individual node per se is not critical and average node length may vary from 1–8 mm, preferably 2–7 mm.

Since the nodes alternate with the intervals in yarns of the invention and since the nodes, as well as the intervals, may vary in length, there may be selected short sections of yarn in which the nodes may comprise somewhat less than 20%. In addition, some interval lengths will be found to be greater or less than the average lengths specified herein. The presence of such yarn sections and interval lengths will not detract from the performance of the yarn as long as, on the whole, the nodes comprise a minimum of 20% of the yarn length and the intervals have an average length of 3–12 mm, preferably 3–8 mm.

The intervals which alternate with the nodes contain asymmetrically splayed substantially unentangled filaments as shown in FIG. 1. It is believed that the splaying of the filaments results because some filaments in the interval are more involved in the adjacent node structure or structures than are the other filaments in that interval. This is, in turn, believed to be a function of the intensity of the entanglement in the node.

As shown in FIG. 1, the interval contains some straight load-bearing filaments extending between the nodes and along the longitudinal axis of the yarn while the remaining or non-load-bearing filaments have varying lengths and splay around the axial load-bearing filaments for greater or lesser distances dictated by their available lengths. The splays can be asymmetrical in either or both of two ways. The filaments may project outwardly to a greater extent on one side of the core filaments than on any other side or more of the filaments in the splayed segment may be situated on one side of the load-bearing filaments than on any other side. In the latter case, the outermost filaments in the splayed segment can extend for the same distance as any other of the outermost filaments which have the same load-bearing filament core although they need not. Thus, the kind and degree of splay which exist along a yarn length are not uniform and the splayed or non-axial filaments in the interval can be either in a single plane or in two or more planes around the load-bearing filaments. The splayed filaments in the intervals are essentially unentangled and they may possess latent crimping potential, as when bicomponent filaments are used.

Although the splay of the filaments in the intervals may appear to be diminished during conversion of the yarn into fabric, it nevertheless contributes increased cover over that achieved using the corresponding unmodified yarn. The splays provide good drape and reappear substantially intact when the yarn is removed from the fabric. The splays also provide fabrics which tend to have a soft hand. This result is believed attributable to the fact that the asymmetrically splayed filaments will not completely nest or bed at yarn intersections. Nevertheless, the yarns of this invention present no snag or filament picking problems upon being processed and they exhibit a high degree of stability and integrity.

Fabrics prepared from the modified yarns of this invention exhibit an unusual random pattern of differing light reflectances that integrates to an overall subdued luster and spun-like appearance. They have an attractive, dry, crisp hand due to the higher friction characteristics of the yarn compared to the feed yarn arising from the intense entanglement in the nodes. The frictional characteristics also account for the fact that terry ground cloth capable of holding a pile in place without pull-apart can be prepared from yarns having the node-/interval structure defined herein although such fabrics are not obtainable from similar unmodified yarns. Fabrics having such characteristics find broad utility, including use in wovens for dress and sportswear, in lightweight knits for dresses and blouses, and in home furnishings such as for draperies, sheer curtains, napery, sheets and pillowcases, the latter especially as a filament/spun yarn combination where the yarns of this invention serve as strong warp yarns. Modification of the smooth-slick look and feel of fabric made from flat, continuous filament yarns provides an aesthetic advantage and gives some fabrics a worsted-like or cotton-like appearance even in the absence of free fiber ends. Suppression of specular reflectance or glitter gives these fabrics a desirable, subdued luster.

Fabrics made from yarns of this invention generally exhibit superior wash-wear performance relative to fabrics made from the corresponding, unmodified feed yarns. They also have unexpectedly good resistance to snagging and superior retention of topical applications such as resins added to impart hydrophilic characteristics (water wickability).

In addition to the foregoing, fabrics which are to be used in clothing and which are prepared from the yarns of this invention have good air permeability. This property provides summer comfort. Fabrics made from the modified yarns of this invention have only moderately less air permeability than fabrics made from the corresponding unmodified yarns, and have a good balance of dry crisp hand and cool comfort. Examples 4 and 6 illustrate these relationships. By contrast, conventional yarn texturing methods used to develop dry tactility in fabrics lead to increased bulk and cover but cause a significant reduction in the air permeability of fabrics prepared from such yarns.

Figure 4:
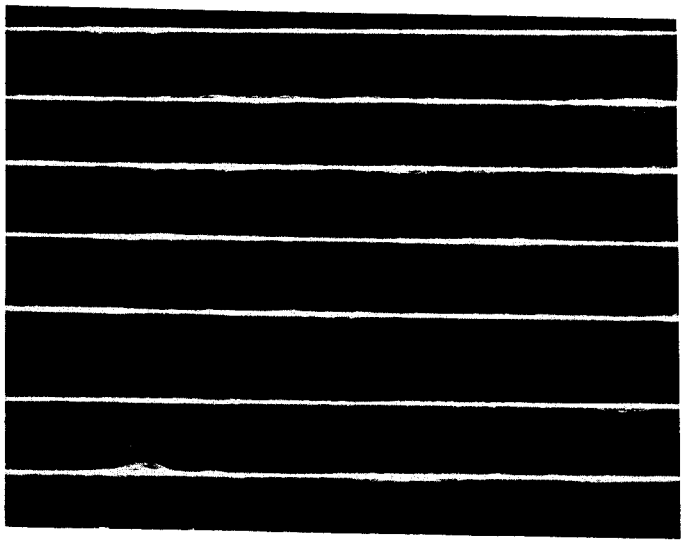
FIG. 4 is an optical micrograph of an effect yarn magnified 3.5X.

A different result can be produced in fabrics prepared from yarns of this invention in which a fraction of the filaments in the yarn has been broken as illustrated in FIG. 4. The fraction of filaments which is broken can determine yarn strength, that is, the yarn can become weaker as the number of broken filaments increases. Accordingly, the fraction of filaments to be broken can be dictated, for example, by the yarn strength desired and can be controlled by using a predetermined ratio of weaker to stronger filaments in the yarn. The filaments that are broken extend freely from, but are securely anchored into, the main structure via the nodes to provide enhanced spun-like aesthetics without the disadvantage of fiber pull-out. As a consequence, an effect yarn, i.e., a modified yarn having a core of essentially continuous filaments and containing free ends, is achieved.

There are certain methods for the preparation of effect yarns in which the filaments are broken and simultaneously entangled in certain instances. In such methods, the broken filaments or fibers contribute to the entanglement by wrapping and interstitching the node. In such a case, free ends can extend from the node itself. The retentivity of such effect yarns is especially high. Also, because the broken filaments are entangled in the node, the average end length is small and similar to that for consolidated spun yarns. (Long average end length is disadvantageous since it tends to cause an undesirable fuzzy fabric appearance and poor pilling resistance.)

The effect yarns of this invention have many of the attributes of both spun yarns and continuous filament yarns and are much more uniform than commercial spun yarns with respect to both denier and strength. For example, a commercial spun yarn has a coefficient of variation of denier of about 14% as measured on a Uster Evenness Tester under standard conditions while the effect yarns of this invention have a coefficient of variation of about 3-5%. Likewise the effect yarns of this invention have more uniform strength due to their core of essentially continuous filaments which provides significantly better processibility. The strength uniformity makes it feasible to use the effect yarns as strong warp yarns in combination fabrics. In addition, the free ends of the effect yarns afford enhanced spun-like aesthetics over the modified yarns of this invention. Preferred effect yarns of this invention typically have an average free end length of 0.8 mm to 2.5 mm with <10% (preferably <5%) being longer than 6 mm. A typical 177 denier (19.6 tex) (30/1 cc) polyester/cotton spun yarn has about a 1.3 mm average free end length with <5% longer than 6 mm. Further, the average free end length can be much shorter than the average interval length of the modified yarns, as shown in FIG. 4.

The number of free ends which are contained in an effect yarn of this invention depends upon the work-to-break (WTB) value of the individual filaments expressed as dyne-cm/cm, fluid pressure, yarn running speed and the amount of overfeed on the yarn going into the entangling jet. Since yarns produced by commercial processes generally have good uniformity, the WTB values of filaments of such yarns are fairly uniform and can be spoken of in terms of average work-to-break ($\overline{WTB}$) for any given yarn. Accordingly, the property for any given group of filaments will be referred to generally hereinafter as $\overline{WTB}$.

Generally, selectivity in filament fracturing becomes greater as the difference between the WTB values of the filaments increases. An effect yarn can be produced from feed yarns wherein the filaments are made from the same polymer having the same relative viscosity (molecular weight) and having the same denier (all of which tend to provide essentially equal strength) under suitable conditions as described herein as long as the filaments do not have exactly the same WTB value and some of them will fracture before others.

Generally, however, feed yarns of two or more kinds of filaments having discretely different $\overline{WTB}$ values are preferred. Where filaments having widely different $\overline{WTB}$ values are used, part or all of the filaments in the group of lower $\overline{WTB}$, but essentially none of the filaments in the group of higher $\overline{WTB}$, are fractured in many sections if the effective work potential of the fluid (Kinetic energy) exceeds only the WTB of the filaments having lower WTB values. The differentiation in WTB can be derived not only by using two or more different polymer compositions, but also by using two or more different molecular weights (RV) of the same or different polymers and by using different filament deniers, cross-sections, elongations or crystallinities or combinations of these. When different filament deniers are used, the filaments to be broken should have a maximum denier of 4 [0.44 tex] and the filaments to remain intact should have a denier of 2-10 [0.22-1.1 tex] as long as the average dpf of the yarn is less than 8 [0.89 tex]. The effect yarn would then be comprised of a core of essentially continuous filaments of higher $\overline{WTB}$ with some of the filaments of lower $\overline{WTB}$ broken into numerous free ends to confer soft tactility to fabrics made from such yarns. Because the filaments of higher $\overline{WTB}$ function as the core, the effect yarns retain strength and strength uniformity.

Preferred feed yarns contain a total of 20-600 filaments, most preferably 20-100, and have a total denier of 40-600 (4.4-66.7 tex). Significantly enhanced spun-like aesthetics can be obtained in fabrics prepared from a 150-200 denier (16.7-22.2 tex) yarn having 2-50 free ends per cm, preferably 8 free ends per cm (20 ends per inch). These yarns have a relatively uniform breaking strength of at least about 30 lbs (133.4 N) which makes them useful for preparing knitted and woven fabrics conventionally without difficulty.

The effect yarns of this invention can also be achieved conveniently by other methods such as, for example, by abrading modified yarns having the unique node-interval structure described herein. A convenient way to abrade such yarns is to pass them over stationary sheets of sandpaper, adjusting the pressure between the sandpaper and the yarn so that a sufficient number of filaments can be broken without serious detriment to the overall yarn structure. An abrasive wheel, such as, for example, a 1 -inch (2.54 cm) diameter wheel shaped as a torus at its outer face can also be used either in line with the process used to modify the feed yarn or in a separate operation independent of the modification process. In either case, the modified yarn is tensioned, guided and forwarded across the rapidly revolving wheel to generate free fiber ends in the yarn. Other methods for abrading yarn known in the art can also be used.

Fabrics prepared from the effect yarns of this invention have enhanced spun-like aesthetics and a firm crisp hand. If mixed dpf staple is used in preparing a spun yarn, a harsh hand results because the higher dpf ends as well as the lower dpf ends are free. In certain effect yarns, the core is composed mainly of higher denier filaments while the lower denier filaments form the free ends, thus providing a fabric with a combination of good body and a soft warm spun-like hand. Further, because the free ends in the effect yarns derive from continuous filaments and are tightly entangled and anchored in the nodes, enhanced spun-like aesthetics are achieved without the disadvantage of fiber pull-out.

Fabrics prepared from the effect yarns of this invention have superior bulk and covering power compared to unmodified yarns and modified yarns without free ends. In many woven constructions the covering power of these yarns surpasses that of commercial spun yarns (see Example 24). The free ends impart a soft, warm tactility to knit and woven fabrics not unlike that obtained with commercial spun yarns, making them especially suitable for shirts, blouses and other apparel. In addition, the high denier uniformity of the effect yarns of this invention provides fabrics with a pleasing visual uniformity superior to that obtained from commercial spun yarns. Because a lofty structure is more desirable in apparel end-uses conventionally employing spun yarns, the preferred level of entanglement is lower for modified yarns with free ends (effect yarns) than for modified yarns without free ends. Preferably, about 25–40% of the effect yarn length is entangled as nodes.

The yarns of this invention can be prepared from any filament forming synthetic organic polymer although filaments of other materials such as silk are also suitable. Illustrative of such synthetic organic polymers are rayons, homopolymers and copolymers of nylons, polyesters, acrylics, polyolefins and aramids and the like. Exemplary nylons are 66 [poly(hexamethylene adipamide)], 6[poly(omega-caproamide)], 6T[poly(hexamethylene terephthalamide)], those disclosed in U.S. Pat. No. 3,416,302 and copolymers such as 66/6T[poly(hexamethylene adipamide/terephthalamide)] and the like. Exemplary polyesters are poly(ethylene terephthalate), poly(trimethylene terephthalate), poly(tetramethylene terephthalate), poly(hexahydro-para-xylylene terephthalate), copolymers such as described in the Griffing and Remington U.S. Pat. No. 3,018,272 and the like. Exemplary acrylics are polyacrylonitrile and its copolymers such as those described by Andres and Sweeny in U.S. Pat. No. 2,837,500 and by Millhiser in U.S. Pat. No. 2,837,501 and the like. Polyolefins include polypropylene as an example and aramids include poly(metaphenylene isophthalamide), poly(para-phenylene terephthalamide), copolymers such as poly(metaphenylene isoterephthalamide) and the like.

In general, the modified yarns of this invention can be prepared from any continuous filament feed yarn having at least 10 filaments, and the effect yarn can be prepared from any continuous filament feed yarn having at least 20 filaments. In such yarns the filaments should have an average dpf of less than about 8 (0.89 tex). Yarns having at least 10 filaments are more easily modified than yarns having less than 10 filaments and at an average of less than 8 dpf (0.89 tex), they provide a higher degree of softness than yarns of a higher dpf. The feed yarn filaments may also have round as well as non-round cross-sections and they may be multilobal, elliptical or multilateral and so on or they may have mixed characteristics, e.g., mixed shrinkage, dpf or cross-section, or they may be bicomponent to enhance fabric tactile or visual aesthetics.

The yarns of the invention are preferably prepared from flat drawn or otherwise oriented yarns, that is, uncrimped and untextured yarns, which have a denier of up to about 800 (88.9 tex) preferably up to about 600 (66.7 tex). Yarns having a denier of up to about 600 are generally textile denier yarns and are preferred for ease of modification. Higher denier feed yarns can also be used as desired as long as they provide the retentivity and overall yarn structure described herein.

Figure 5:
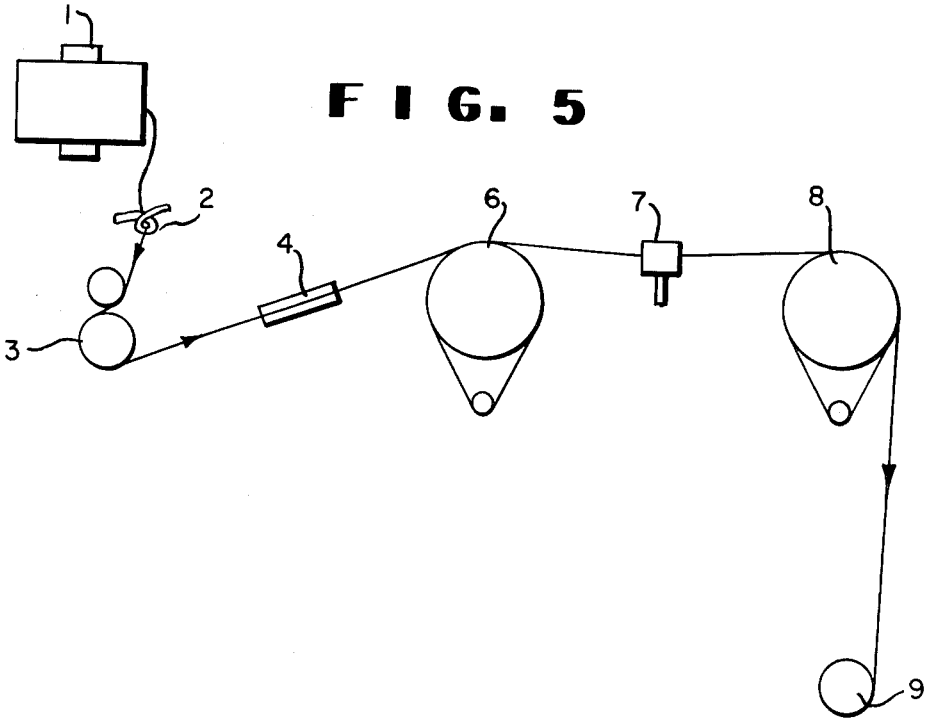
FIG. 5 is a schematic diagram of one process used to prepare the yarns of this invention.

The yarns of this invention can be made from a mixed filament feed yarn in which the mixed filaments have different draw retraction forces. Such yarns can be prepared from a suitable number of filaments of different polymer compositions or the yarn can consist of a number of bicomponent filaments and monocomponent filaments. A side-by-side bicomponent yarn in which the two components may later be split apart can also be used. The undrawn cospun yarn can be supplied from a package or from a continuous filament spinning machine with the yarn being spun, drawn and converted to the products of this invention all in one operation. Processing speeds up to 1000 m/min or higher can be used in such cases. In one embodiment, an undrawn cospun feed yarn is fed from a supply package to the feed roll of a standard draw winder, drawn over a hot plate or hot pin maintained at a suitable temperature and then passed through a jet to give the nodes and intervals herein described. As shown in FIG. 5, the yarn is withdrawn from supply roll 1 and passed through yarn guide 2 by feed rolls 3 which control the draw ratio. The yarn is drawn by draw rolls 6 over a hot plate or pin 4 maintained at a suitable temperature to assist in the drawing of the particular polymer or polymers being used. The speed of the draw rolls is held constant and the draw ratio is adjusted by changing the feed roll speed. From draw rolls 6 the yarn is passed through any standard interlacing jet 7 such as, for example, any of those described in U.S. Pat. Nos. 3,426,406; 3,364,537 and the like. The modified yarn is then passed over relaxation rolls 8 which are operated at a slower speed than the speed of draw rolls 6. The resulting modified yarn is wound up onto package 9.

It is hypothesized that the differential retraction immediately after draw of the filaments of the multicomponent yarn provides excess filament length in some of the filaments when the yarn is overfed to the interlacing jet. This excess length is essentially under zero tension while the remainder of the yarn is under tension. As a consequence, the excess length is entangled into the nodes of the yarns of this invention. With monocomponent yarns, more strenuous jet conditions are necessary to give the desired structure.

The unique node-interval structure of this invention can also be achieved by feeding the yarn to be modified from a supply roll, wetting the yarn with water and feeding the wetted yarn, typically, through a pair of canted jets in series. As illustrated in FIG. 8, feed yarn 21 is withdrawn from package 31 through tensioner 22 by feed rolls 23 and 24 that control the feed rate. Output rolls 28 and 29 are run at a slightly lower speed to establish the desired overfeed of yarn in the process. After leaving feed roll 24, the yarn passes through applicator jet 25, then two interlacing jets 26 and 27 in series, generally canted as indicated at 45° to the threadline. Water, or other suitable fluid, is fed into inlet 51, and a pressurized gas, preferably air, is fed into inlets 61 and 71 (and to additional gas inlets not shown if required by the specific jet design). Modified yarn 32 is wound onto a package by winder 33. Any other suitable method may also be used.

TESTING PROCEDURES

Node and Interval Lengths (Manual)

One end of a 115 cm length of yarn is clamped at one end of a horizontally mounted meter stick. A weight calculated as a load of about 0.01 gpd on the yarn is attached to the other end and the yarn is passed over a pulley and allowed to hang freely beyond the opposite end of the meter stick. A smooth, pointed pin is inserted perpendicularly through the interval nearest the clamped end and gently moved back and forth manually to identify the points where nodes begin; the applied force should be selected to neither break nor stretch the filaments — about 5–10 g. is adequate for textile deniers. The distance between nodes at each end is noted on the meter stick and recorded to the nearest mm. This procedure is repeated until 74 intervals alongside the meter stick have been measured, or until all of the intervals in the meter length have been measured if there are less than 74, and the corresponding total yarn length noted. The node lengths reported are the distances between measured intervals. The calculations are as follows:

$$\text{average interval length} = \frac{\text{sum of all interval lengths measured}}{\text{number of lengths measured}}$$

$$\text{average node length} = \frac{\text{yarn length} - \text{sum of all interval lengths measured}}{\text{number of lengths measured} - 1}$$

$$\%\ \text{interval length} = \frac{\text{sum of all interval lengths measured}}{\text{yarn length}} \times 100$$

$$\%\ \text{node length} = 100 - \%\ \text{interval length}$$

Node and Interval Lengths (Rothschild Yarn Entanglement Tester)

Equipment available commercially can also be used to determine node and interval lengths and characterize the yarns of this invention. The Rothschild Yarn Entanglement Tester diagrammatically illustrated in FIG. 7 can be used for this purpose. The yarn is strung up on the machine as shown, a needle is inserted and the yarn is pulled under ten gram running tension until the needle encounters a predetermined trip tension set at twenty grams for the data summarized in Table 5. After the trip tension is reached, the yarn is stopped, the needle is removed and the yarn is pulled a specified skip distance which is 9 cm (3.5 inches) for the data summarized in Table 5. When the skip distance is reached, the yarn is stopped, the needle is inserted and the process is repeated. The Rothschild data reported herein is based on 300 or more pin counts taken over about a 40 yard length of yarn.

Because of the nature of the entanglement in the yarns of this invention, the pin count is a function of skip distance if the skip distance is 1 or 2 cm, but not if the skip distance is 5 cm or longer. In other words, the insertion of the pin becomes random with respect to the short entangled sections at distances of 5 cm or more.

The pin count data are then displayed into a histogram so that portions of the curve can be examined and used to calculate the following parameters:

$$\text{Mean} = \frac{\text{Sum of all lengths measured}}{\text{Number of pin insertions}}$$

$$\%(\text{Zero's}) = \left(\frac{\text{Number of times pin failed to penetrate}}{\text{Number of pin insertions}}\right) \times 100$$

$$\%(\leqq 3\ \text{mm}) = \left(\frac{\text{Number of pin count lengths less than 4 mm}}{\text{Number of pin insertions}}\right) \times 100$$

$$\%(>15\ \text{mm}) = \left(\frac{\text{Number of pin count lengths greater than 15 mm}}{\text{Number of pin insertions}}\right) \times 100$$

However, it is possible that certain fine denier yarns will be stretched because of the yarn tensions involved in using the Rothschild Yarn Entanglement Tester. If there are no counts at 1 and 2 mm (and possibly at succeeding consecutive counts), the histogram should be reconstructed by subtracting the highest length with zero count from all nonzero pin count numbers. The above four parameters are then calculated from the revised histogram.

FREE END TESTS

Test I Free End Count

The equipment for carrying out this test includes a jig comprising a rectangular brass plate having (1) a set of locating pins, two on each side of the plate, for positioning an 8.3 cm × 10.2 cm (3.25 in. × 4 in.) glass slide and (2) a set of guide pins, five on each of the short sides of the rectangular plate spaced approximately 1.25 cm apart, for positioning segments of yarn in parallel lines. The rectangle defined by the guide pins is filled by a piece of black velvet to provide a high-contrast background. In carrying out the test, the slide is placed between the locating pins and the yarn to be examined is taped to the upper left-hand corner of the plate, then run successively back and forth across the plate in five parallel lines, using the guide pins to hold the yarn in position, the yarn finally being taped again to the plate at the lower right-hand corner. A second glass slide, taped along each of its short ends with strips of tape approximately 1 cm wide having adhesive on each face of the tape, is then placed between the locating pins and pressed firmly against the lower slide. This seals the slides together and anchors the yarns. The excess protruding loops around the guide pins are then cut free. The joined slides are then removed from the jig and the short ends are wrapped with masking tape approximately 1 cm in width to complete the mounting operation. The pair of slides is then placed on a microscope stage at 15× magnification, where the visible free ends in the five yarn segments (each approximately 8 cm long) are counted. A record of the visible free ends in each segment is made on the tape at the right end of that segment. The total number of free ends visible in all of these segments is then obtained by adding the numbers obtained for each of the segments, and the total is divided by the total length of yarn scanned to obtain the average number of free ends per centimeter.

Test II Free End Length and Ends/cm

About a 35 cm length is cut from the yarn to be tested. The yarn is taped at both ends to a clear plastic straight edge, which has been marked off in 1 cm segments. The yarn is placed so that it lies straight but not under tension and is then covered with a second clear straight edge. The yarn is viewed on a shadowgraph (e.g., Wilder Varibeam, Optometric Tools, Inc., Rockleigh, N.J. 07647 or Nippon Kogaku K.K., Japan Model 6) at 20× magnification, and all of the following measurements are made on the screen on which the yarn image is projected. Through 30 cm of yarn length, the number of free ends in each 1 cm segment is counted and recorded, and the length of each free end measured by following its path with a small ruler or a calibrated string. Individual lengths are recorded in increments of 1 mm for lengths in the range of from 0 up to 4 mm and in increments of 2 for lengths longer than 4 mm. Any length greater than the last integer or 0 is recorded as the next whole number, or if longer than 4 mm, it is recorded as the next even whole number (e.g., a length of 0.2 mm would be recorded as 1 mm, a length of 4.1 mm would be recorded as 6 mm, keeping in mind that the actual readings are done at 20×; therefore, a 1 mm free end length is measured as 20 mm on the screen). Two additional 30 cm yarn lengths are analyzed for the number of free ends in 1 cm segments, but not for end length.

The following calculations are made from the data obtained as described above:

$$\text{Free End/cm} = \frac{\text{No. free ends counted in 90 cm}}{90}$$

$$\text{Fraction of free ends in range} = \frac{\text{No. of free ends in range}}{\text{Total No. free ends measured}}$$

$$\text{Midpoint of increment} = \frac{\text{Lower end of increment} + \text{upper end of increment}}{2}$$

For each increment, the lower end is the upper end of the previous increment.

Avg. Free End Length = The sum of the values obtained by multiplying the fraction of free ends in each increment by the midpoint of the increment % Free Ends > 6 mm =

$$\left(\frac{\text{No. Free ends} > 6\text{ mm in 30 cm}}{\text{Total number of free ends measured}}\right) \times 100$$

Node Retentivity - Dynamic Stability Test

Retentivity of the entangled nodes in textile processing is predicted with good precision by a test in which a loop, formed of about five yards of yarn is subjected for a defined period of time, to conditions which simulate the textile processing conditions under which the yarn is converted to a fabric and finished.

With reference to FIG. 6, yarn 12 is wrapped around tensioner 16 with the end left free at top, through tensiometer 19, across ceramic guide 18 at an angle of 120°, wrapped seven times around drive roll 14 and canted idler roll 15, through pigtail 17. The ends of the loop are tied together securely, and the tensioner is adjusted to apply a load equal to 0.14 gpd on the yarn as it passes the ceramic guide. (The return loop of the yarn from the drive roll to the tensioner is under zero tension.) The yarn speed is controlled at 30 ypm (27 m/min). Once the tension and speed are adjusted, a fresh sample of yarn is mounted by the same procedure and run for 0.5 minute, then removed and tested in the Node and Interval Lengths measurement. The percentage of the original node length retained after the yarn undergoes the dynamic stability test is the retentivity.

Breaking Strength (Yarn)

A skein of 20 yards (110 m) of yarn is wound on a 54 inch (137 cm) circumference reel (8.6 inch [21.9 cm] radius), and broken to obtain lbs-to-break with a Scott Tester (Model DH., No. B38850), built by Scott Tester Inc., Providence, R.I. The lbs-to-break is recorded as the breaking strength of the yarn in the examples.

Work-to-Break (WTB)

The procedure described in ASTM D-885-72, Section 26 is used to measure the work-to-breakk of a 10 inch (25.4 cm) filamento The average work-to-break is determined by averaging the work-to-break values of a representative number (i.e., 5) of the filaments to be broken. The work-to-break in dyne-cm/cm is equal to (X) × (Y) × (Z) × ($g_c$) where X = area under the load-elongation curve (cm$^2$), Y = load scale factor in gram force ($g_f$) per cm of chart, Z = elongation scale factor (cm/cm) of specimen per cm of chart, $g_c$ = gravitation constant (dynes/$g_f$), 980 dynes/$g_f$.

Relative Viscosity (RV)

The relative viscosity of the homopolyesters and the copolyesters used in the examples is measured at 25° C (77° F) as the ratio of the viscosity of a solution of 0.8 g of polymer dissolved at room temperature in 10 ml of hexafluoroisopropanol containing 100 ppm $H_2SO_4$ to the viscosity of the $H_2SO_4$-containing hexafluoroisopropanol alone.

The relative viscosity of nylon 66 is measured at 25° C as the ratio of the viscosity of a solution of 5.5 g of polymer dissolved in 50 ml of a mixture of 90 parts of formic acid and 10 parts of water to the viscosity of the formic acid/water mixture itself.

The relative viscosity of nylon homo- or copolymers of hexamethylene dodecamide including that used in Examples 10A and 11 is measured at 25° C as the ratio of the viscosity of a solution of 5.5 g of polymer dissolved in a 50 ml Fanol solution (50 parts phenol/50 parts formic acid) to the viscosity of the Fanol solution itself.

Fabric Bulk Determination

Fabric thickness in inches is measured at 5 g/cm$^2$ pressure over an area of about 7 cm$^2$. The inches are converted to cm and bulk is calculated by dividing thickness in cm by the fabric unit weight in g/cm$^2$, and is reported in cc/g.

Light Transmission Determination

Light transmission is determined using a Durst No. 609 projector (Durst SA, Bolzano, Italy), a Photomultiplier Microphotometer, Cat. No. 10-211 American Instrument Co., Silver Spring, Md. 20900 and a Solovolt constant voltage transformer, 0.261A, 115 V AC, Sola Electric Co., Chicago, Ill. 60650 (or equivalent) in power supply.

The equipment is equilibrated and calibrated according to instructions by the manufacturers. In general, the photometer is used only after being energized for at least 24 hours and it is calibrated after allowing the projector to warm up at least five minutes.

Two 6 × 30 inches (15.2 × 76 cm) samples of fabric are used, one having its long dimension along the warp, and the other with its long dimension at right angles thereto. They are selected from areas of the fabric no closer to the selvages than one-tenth of the fabric width. If wrinkles are apparent, they are removed by pressing lightly. The samples are conditioned at 70° ± 2° F (21° ± 1° C) and 65% ± 2% relative humidity for 16 hours before testing.

The conditioned samples without being stretched, are carefully placed between well-cleaned glass pressure plates and 5 meter readings of % transmission are taken at different areas along their lengths. The meter multiplier setting required to obtain a scale reading of 15–85% and the meter reading to the nearest 0.5% are recorded. (Prolonged exposure of the photomultiplier to an amount of light exceeding that giving a 100% transmission reading must be avoided, since it results in a reduction in sensitivity). The apparatus is recalibrated before testing the second sample.

The % light transmission is calculated by multiplying the meter reading by the multiplier setting and averaging the five values thus obtained. The precision of repeated measurements on the same sample is about ± 3%.

The invention is further illustrated but is not intended to be limited by the following examples in which all pressure values are gauge measurements and all parts and percentages are by weight unless otherwise indicated.

EXAMPLE 1

Two ends of 70 denier (7.8 tex)-34 filament yarn, comprising a basic-dyeable copoly[ethylene terephthalate/5-(sodium sulfo) isophthalate] (98/2 weight ratio) having a relative viscosity of about 16 are combined and modified using the process shown schematically in FIG. 8. The filaments of this yarn have substantially symmetrical trilobal cross-sections. The yarn is fed into feed rolls at a speed of 1000 ypm (914 m/min) and passed through a wetting jet constructed as described in U.S. Pat. No. 3,426,406 and having an oval yarn entrance orifice of 0.254 cm width and 0.396 cm length with 0.178 cm diameter round air (water) inlet orifices and well-wet with water at a water flow rate of about 30 ml/minute. The wet yarn is passed through two interlacing jets constructed as described in U.S. Pat. No. 3,426,406 and situated in tandem about 10 cm apart. Each interlacing jet has an oval yarn entrance hole of 0.193 cm width and 0.305 cm length with 0.117 cm diameter round air entrance orifices and is operated at 175 psi (1207 kPa) pressure of air while canted at an angle of 45° relative to the threadline. A pair of rolls takes up the yarn at a speed of 967 ypm (884 m/min) and feeds it to a constant-tension windup device. The tenacity and elongation of the yarn thus modified are 2.3 gpd (203 mN/tex) and 11.6%, respectively. The corresponding values for the modified feed yarns are 2.8 gpd (247 mN/tex) and 21.8%. Other properties of the modified yarn are given in Table 5.

The modified yarn of this example and, for comparison, the feed yarn of this example are knitted into 18-cut (7.1 needles/cm) Swiss Piquê fabrics. These are finished by beck-scouring and beck-dyeing at atmospheric pressure, the final rinse containing 1% of a quaternary ammonium softener. After being slit and dried at 250° F (121° C), fabrics are heat-set at 350° F (177° C) for 30 seconds at 55 inch (140 cm) width and 15% overfeed, and semidecated 3 × 3. Finished weights are 258 g/m$^2$ for the modified yarn fabric and 238 g/m$^2$ for the comparison fabric. Fabric-to-fabric friction coefficients, $\mu$, * are 0.41 for that from the modified yarn and 0.29 for that from the comparison. The test fabric has a distinctly drier hand, a crisp tactility and an attractive, subdued luster.

* Calculated as the average force (F) in grams required to move a fabric-bottomed sled at 200 inches/min (51 cm/min) across a horizontal, fabric-covered surface in two directions in which the face-to-face fabric movement is first in parallel and then in 180° (opposed) orientations under a loading of 5 g/cm$^2$ of sled area, divided by the weight of the sled plus fabric. ($\mu$ = F/sled weight)

EXAMPLE 2

A cospun 120 denier (13.3 tex) - 72 filament nylon yarn prepared as described in Example 1 of U.S. Pat. No. 3,416,302 is modified as described in Example 1 herein, except that steam is used in the first interlacing jet. Both jets are operated at 150 psi (1034 kPa) and the yarn is fed at 999 ypm (914 m/min) and wound up at 983 ypm (899 m/min). The properties of the resulting yarn are given in Table 5.

A 22-cut (8.7 needles/cm) Swiss Piqué fabric is made from this yarn. It is finished to 58 inch (147 cm) width with 35 wales, 44 courses per inch (14.17 per cm) and a weight of 212 g/m$^2$. Finishing procedure consists of heat setting the slit fabric at 375° F (190° C) for 45 seconds at 60 inch (152 cm) width with 30% overfeed, tack-sewing the fabric to tube form, solvent scouring at 180° F (82° C) and pressure dyeing in a jet-beck at 250° F (121° C). After being slit and dried at 250° F (121° C), the fabric is heat-set at 350° F (177° C) for 45 seconds at 58 inch (147 cm) width using 7.5% overfeed. The finished fabric is found to have a soft, spun-like feel.

EXAMPLE 3

Two ends of 70 denier (7.8 tex)-26 filament yarn, having an equal number of nylon 66 and poly(ethylene terephthalate) filaments having substantially symmetrical trilobal cross-sections are used. The polyester represents 60% by weight of the yarn and has a relative viscosity of 19 while the nylon represents 40% by weight of the yarn and has a relative viscosity of 50. The two ends are combined and modified as described in Example 1 except that 150 psi (1034 kPa) steam is used in the first jet and the speeds of the feed rolls and the take-up rolls are 1000 ypm (914 m/min) and 986 ypm (902 m/min), respectively. The resulting yarn has a tenacity and elongation of 3.5 gpd (309 mN/tex) and 20.5%, respectively. The values for the corresponding unmodified feed yarn are 3.9 gpd (345 mN/tex) and 24.4%. Other properties of the resulting yarn are given in Table 5.

A crow's foot weave fabric is made using the modified yarn of this example as filling with an unmodified commercial 70-34 nylon 66 warp. For comparison purposes, a similar fabric is made using two ends of the unmodified feed yarn as filling. Loom construction is 120 ends × 94 picks. The fabrics are finished by scouring and dyeing under standard conditions for nylon 66 and are subsequently dried and heat-set on a clip frame at 375° F (190° C) for 1 minute at 1 inch (2.54 cm) over wet width. The fabric produced from the yarn of this example has a fabric-to-fabric friction coefficient, $\mu$ calculated as described in Example 1, of 0.72 vs 0.59 for the fabric produced from the unmodified feed yarn.

EXAMPLE 4

This example illustrates how varying average interval length and percent node length in the yarn effects cover in fabrics.

A 140 denier (15.5 tex)-68 filament yarn of a basic-dyeable, octalobal cross-section copoly[ethylene terephthalate/5-(sodium sulfo)isophthalate] (98/2 weight ratio) having a relative viscosity of 16 is modified as in Example 1 except that each jet has a yarn passage having an oval shape with a 0.157 cm width and a 0.254 cm length and a circular air passage of 0.097 cm diameter. The first jet wets the yarn as described in Example 1 and the second and third jets tightly entangle the yarn at 180 psi (1241 kPa) of air pressure each. Windup (jet-output) speed is 1000 ypm (914 m/min).

Three lots of product are made at varying input speeds. These yarns and the unmodified feed yarn are knitted into 22-cut (8.7 needles/cm) interlock fabrics which are finished by steam calendering twice at 6 inches (15.2 cm) under dry width with 22% overfeed to allow for gradual shrinkage. Fabrics are then beckscoured and atmospheric-pressure dyed under standard conditions for basic-dyeable polyester. After dying, the fabrics are steam calendered twice at 26 inches (66 cm) and 28 inches (71 cm), respectively, with maximum overfeed, and heat-set at 340° F (171° C) at 62 inch (157 cm) width and 15% overfeed. Fabric characteristics are:

TABLE 1

| In-put Speed m/min | Average Length mm Node | Interval | % Node Length | Fabric Weight g/m² | Bulk cc/g | Air Permeability m³/min/m² |
|---|---|---|---|---|---|---|
| 942 | 4.6 | 4.2 | 52 | 195 | 3.8 | 152 |
| 928 | 3.9 | 7.5 | 34 | 194 | 3.6 | 182 |
| 923 | 3.4 | 10.8 | 24 | 188 | 3.5 | 192 |
| From unmodified yarn | — | — | — | 193 | 3.4 | 198 |

Hence, an increase in percent node length results in an increase in both bulk and cover (the latter being reflected in the air permeability of the fabrics as measured as ASTM Method D-737—46).

EXAMPLE 5

This example illustrates the suitability of a cospun polyester yarn as feed.

An ethylene terephthalate/5-(sodium sulfo) isophthalate (98/2 weight ratio) copolymer of 15RV and an ethylene terephthalate/glutarate (87.5/12.5 weight ratio) copolymer of 32 RV are separately melted and 13 filaments of each extruded at a spinneret temperature of 295° C to form a 26-filament composite yarn. The glutarate copolymer is spun through a spinneret as taught in the Holland U.S. Pat. No. 2,939,201 to yield trilobal filaments having a modification ratio of about 2.1; the other 13 filaments are round. The yarn is air quenched and drawn to 330% of its as-spun length in a jet supplied with 220° C 80 psi (552 kPa) steam to yield a 70-denier (7.8 tex) yarn. The yarn is passed from an unheated draw roll at 3500 ypm (3200 m/min) to a second set of rolls running at the same speed and heated to 266° F (130° C). The yarn is interlaced as described in the Bunting et al. U.S. Pat. No. 2,985,995 and wound up.

Two ends of this yarn are combined and modified by the general procedure of Example 1 by being fed at a speed of 1033 ypm (945 m/min) through an interlacing jet operated at an air pressure of 185 psi (1276 kPa) and wound up at a speed of 1002 ypm (916 m/min). The properties of the resulting modified yarn are given in Table 5.

The modified yarn of this example and, for comparison, two ends of the unmodified feed yarn are knitted into 22-cut (8.7 needles/cm) single jersey fabrics. These are finished essentially as described in Example 4, except that final heat setting is done at 50 inches (127 cm) width with 10% overfeed. A heather effect is achieved by dyeing only the basic-dyeable filaments in the fabric. Fabric weight and bulk are 143g/m² and 3.4 cc/g for the modified fabric and 156 g/m² and 2.8 cc/g for the comparison fabric. In addition to a dryer hand, the modified fabric has a finer heather appearance.

EXAMPLE 6

A 150 denier (16.7 tex)-68 filament yarn of poly (ethylene terephthalate) having a relative viscosity of 22 is modified as in Example 1 by being wetted and fed at 1030 ypm (942 m/min) to two interlacing jets in tandem, each having an oval yarn passage having a width of 0.157 cm and a length of 0.254 cm with a round gas orifice 0.097 cm in diameter, and each operated at 190 psi (1310 kPa) air pressure. The yarn is withdrawn at 1000 ypm (914 m/min) and wound up and its properties are given in Table 5.

The modified yarn, the unmodified feed yarn and a false-twist set-textured (FTST) yarn of identical composition and count are all knitted to 28-cut (11.0 needles/cm) LaCoste fabrics. These are finished by tumble-relaxing at 199° F (93° C) for 30 minutes, jet-scouring and dyeing at atmospheric pressure under standard conditions for disperse-dyeable polyester, steam calendering and heatsetting at 350° F (177° C) for 30 seconds at about 66 inches (167 cm) width and about 10% overfeed.

TABLE 2

| Yarn Used | Fabric Characteristics Weight g/m² | Air Permeability m³/min/m² |
|---|---|---|
| Flat (feed yarn) | 180 | 339 |
| Modified | 180 | 237 |
| FTST | 170 | 91 |

The fabrics made of the modified yarn and the FTST yarn have a crisp dry hand as compared with the slick tactility of the fabric prepared from the flat yarn. The fabric prepared from the modified yarn has a much higher air permeability than the FTST yarn fabric. Air permeability (as measured by ASTM Method D-737—46) is a primary factor in the summer comfort of fabrics.

The fabrics made of the modified yarn and the FTST yarn are tested on the ICI MACE Snag Tester as described by Leung and Hershkowitz in the Textile Research Journal, Volume 45, #2, page 93, February, 1975, and found to have the following ratings on a 1–5 scale, where 5 is the best: Modified yarn fabric: 2.4 wale direction, 2.7 course direction; comparison fabric made from FTST yarn was rated 1.0 in both direction.

The fabrics are also treated as follows. They are first washed twice in a home-type washing machine and, after being dried, they are soaked in acetone overnight. The fabrics are wrung out, dried and soaked in a mixture containing five volumes of water and one volume of a wicking agent such as that prepared by reacting a melamine formaldehyde condensate with a long chain alkanol or a polyethylene glycol. After being dried, the fabrics are cured at 347° F (175° C) for 1 minute, and are "C" washed for the number of times given below and tested for wicking rate. (A "C" wash is done in a home-type washing machine at high water level [17 gal (64.5 l)] with 5 minutes agitation, using 100° F (38° C) water and 30 g detergent. The fabrics are dried in a home-type dryer for 30 minutes at 160° F (71° C) and for 5 minutes without heat. If to be rated for wash-wear, the fabrics are removed promptly and hung.)

Water wicking rates are measured according to the procedure described in U.S. Pat. No. 3,774,387 with the following modifications. A 2 inches (5.08 cm) diameter circle of fabric is mounted on the polytetrafluoroethylene form shown in FIG. 2 of U.S. Pat. No. 3,774,387 by taping it across the back. Dimensions of the form are as given for FIG. 2 except dimension 12 which is 3.4 cm. A fabric surface of about 15.7 $cm^2$ is thus formed. The back side of the form covered with fabric is glued to the bottom of a 300 g weight (500 g weight given in patent). The apparatus given in the patent is used but the top of the fritted glass plate is positioned at the same height as the top surface of the horizontal reservoir. The fabric-covered form/weight assembly is put on the fritted glass and the movement of the meniscus in tube 23 of FIG. 3 of U.S. Pat. No. 3,774,387 is observed and recorded at appropriate intervals. The initial wicking rate in ml/sec is then determined Results are:

TABLE 3

| Fabric Condition | No. of "C" Washes | Wicking Rate, ml/sec Flat | Modified | FTST |
|---|---|---|---|---|
| Acetone Washed | 0 | $10^{-4}$ | $10^{-4}$ | $10^{-4}$ |
| Acetone Wicking | 0 | $2.2 \times 10^{-1}$ | $2.2 \times 10^{-1}$ | $6.4 \times 10^{-}$ |
| Washed Agent | | | | |
| " | 1 | $8.9 \times 10^{-2}$ | $1.5 \times 10^{-1}$ | $3.4 \times 10^{-2}$ |
| " | 5 | $8.9 \times 10^{-2}$ | $1.1 \times 10^{-1}$ | $1.5 \times 10^{-2}$ |
| " | 10 | $1.1 \times 10^{-2}$ | $1.5 \times 10^{-1}$ | $1.1 \times 10^{-2}$ |
| " | 20 | $7.4 \times 10^{-2}$ | $1.1 \times 10^{-1}$ | $5.9 \times 10^{-3}$ |

EXAMPLE 7

A 70 denier (7.8 tex)-34 filament yarn of poly (ethylene terephthalate) having a relative viscosity of 22 is modified as described in Example 6 to yield a yarn having the properties given in Table 5.

The yarn is woven into a plain weave ninon fabric, loom construction is 64 ends × 64 picks. The greige fabric is heat-set at 350° F (177° C) for 30 seconds, bleached and dried under standard conditions used for polyester. Finished weight is 44 g/$m^2$. This fabric and a comparison commercial ninon polyester fabric having a weight of 47 g/$m^2$ are given 10 "C" washes as described in Example 6 and rated subjectively after 1, 3, 5 and 10 washes for wash-wear characteristics (absence of wrinkling). The rating is on a scale of 1–5, 5 being complete absence of wrinkles. The results reported below are the average of ratings by two people comparing against carefully rated standards similar to AATCC's standards 124—1967T.

TABLE 4

| Wash No. | Fabric Wash-Wear Rating Modified | Comparison |
|---|---|---|
| 1 | 4.6 | 2.2 |
| 3 | 3.6 | 2.0 |
| 5 | 3.7 | 2.0 |
| 10 | 2.8 | 2.0 |

EXAMPLE 8

A dull, antistatic 70 denier (7.8 tex) 34 filament yarn of nylon 66 having a relative viscosity of about 43 is wetted and fed through two interlacing jets in tandem as described in Example 3 except that each jet is modified to accommodate a small ceramic pin at the yarn entrance to minimize wear. The yarn is accumulated at a wind-up speed of 1000 ypm (914 m/min) with a feed speed of 1025 ypm (937 m/min). The air pressure in the interlacing jets is 150 psi (1034 kPa). The properties of the resulting modified yarn are given in Table 5.

The modified yarn and, for comparison, the feed yarn of this example, are knitted on a 2-bar tricot machine using jersey stitch, runners 68 inches/44 inches (173 cm/112 cm) and quality 9 inches (23 cm). The fabrics are scoured one pass open width, relaxed, at 210° F (99° C), beck-dyed under standard nylon 66 conditions, and heat-set at 400° F (204° C) at 45 wales and 47 courses per inch (18.19/cm). Weights are 112 g/$m^2$ for both fabrics. The modified fabric has a crepe-like look with an attractive speckled or grainy effect and has a crisp dry hand. The comparison fabric is slick to the touch and uniformly shiny.

EXAMPLE 9

This example illustrates the use of a splittable bicomponent feed yarn. Bicomponent spinning is well known. in the art as evidenced by U.S. Pat. No. 3,038,235.

Side-by-side bicomponent yarn composed substantially of 30% nylon 66 containing 10% rutile $TiO_2$ as one component and 70% poly(ethylene terephthalate) as the other is spun as described below. The relative viscosities of the polymers are 45 and 32, respectively.

Each polymer is melted in a screw melter and metered to a spinneret in which the melts are metered into each hole from adjacent, concentric channels at rates to provide the desired filament denier and polymer ratios. Temperatures in the screw melters range (feed to discharge) from 260° to 290° C for the polyester and from 240° to 290° for the nylon. Block and spinneret temperatures are 290° C. An aqueous finish containing 50 parts of mineral oil, 20 parts of sulfonated peanut oil and 20 parts of potassium oleate is applied. A 400-denier (44.4 tex) 34-filament yarn is wound up at 400 ypm (366 m/min).

The yarn is further processed on a Whitin RK draw winder modified by having an interlacing jet mounted horizontally between the draw roll and the relaxation roll as shown in FIG. 5. The interlacing jet is similar to that shown in FIGS. 11 and 12 and Example III of U.S. Pat. No. 3,364,537, the difference being that instead of the two guide air conduits 67 of the patent, the jet has four guide air conduits, each directed toward the yarn passage and at a 45° angle to the jet base. Air is fed to the orifices at a pressure of 60 psi (414 kPa).

The draw-winder feed rolls are operated at a surface speed of 77 ypm (71 m/min) and the draw rolls at 258 ypm (236 m/min) and the yarn is drawn 3.3X over a hot plate at a temperature of 120° C. The relaxation rolls are driven at 252 ypm (231 m/min) representing an overfeed to the jet of 2.3%. The yarn is wound up at 243 ypm (222 m/min), representing a windup relaxation of the yarn of 3.7%.

The properties of the resulting modified yarn are given in Table 5.

EXAMPLE 10

This example illustrates the use of a cospun feed yarn composed of both bicomponent and single-component filaments.

A. The composite yarn has 9 filaments of a copolymer of 70% poly(hexamethylene dodecamide) and 30% poly(hexamethylene terephthalamide) having a relative viscosity of 35.6 and 27 bicomponent filaments of the same copolymer as one component (50%) and nylon 66 having a relative viscosity of 45 as the other. The copolymer is screw melted over a temperature range of 250° C to 295° C and the nylon 66 is screw melted over a temperature range of 240° C to 280° C. The block and spinneret temperatures are 300° C. The 400 denier (44.4 tex)-36 filament yarn is wound up at 500 ypm (457 m/min).

The modified draw winder of Example 9 is used to process the yarn further. Feed roll speed is 71 ypm (65 m/min) and draw roll speed is 250 ypm (229 m/min) and the yarn is drawn 3.5X over a hot plate at a temperature of 120° C. Jet air pressure is 80 psi (552 kPa). The speed of the relaxation rolls is 216 ypm (198 m/min) (15.7% overfeed to the jet). The yarn is wound up at 220 ypm (201 m/min).

The properties of the resulting modified yarn are given in Table 5.

B. A second 400 denier (44.4 tex)-36 filament yarn is prepared substantially as in A. above and contains 9 filaments of a 60 RV nylon 66 and 27 bicomponent filaments of equal weights of the same nylon 66 and 30 RV poly (ethylene terephthalate). Screw melter temperatures are 250° C - 285° C for both components. Block and spinneret temperatures are 300° C. The yarn is wound up at 500 ypm (457 m/min)

The modified draw winder of Example 9 is used to prepare a yarn of this invention using an air pressure of 80 psi (552 kPa) in the jet. Feed roll speed is 55 ypm (51 m/min) and draw roll speed is 250 ypm (229 m/min) and the yarn is drawn 4.5X over a cold pin. Relaxation roll speed is 230 ypm (210 m/min) (8.7% overfeed to the jet). The yarn is wound up at 226 ypm (207 m/min) (1.7% windup relaxation of the yarn). The properties of the resulting modified yarn are given in Table 5.

EXAMPLE 11

The feed of this example is a cospun yarn composed of both bicomponent and single-component filaments. This composite yarn has 9 filaments of a copolymer of 70% poly(hexamethylene dodecamide) and 30% poly(hexamethylene terephthalamide) having a relative viscosity of 35.6 and 27 bicomponent filaments of the same copolymer as one component (50%) and poly(ethylene terephthalate) having a relative viscosity of 30 as the other. The filaments of the 400 denier (44.4 tex)-36 filament yarn have substantially symmetrical trilobal cross sections and are spun and wound up at 500 ypm (457 m/min).

The modified draw winder of Example 9 is used to process the yarn further. Feed roll speed is 89 ypm (81 m/min), and draw roll speed is 259 ypm (237 m/min) with 2.9X draw over a 3 inches hot plate at 150° C. The air pressure through the jet, located 12 inches (30 cm) from the draw rolls and between the draw rolls and the relaxation rolls, is 80 psi (552 kPa). The relaxation roll speed is 238 ypm (218 m/min). The yarn is wound up at 228 ypm (208 m/min) and has 21 ends per inch (8.3 ends per cm) and a breaking strength of 111 lbs (494 N). Other properties of the modified yarn are given in Table 5.

EXAMPLE 12

Two ends of 70 denier (7.8 tex)-34 filament poly(ethylene terephthalate) (relative viscosity of 22) yarn having filaments of round cross-section are processed by the procedure described in Example 1 except that the yarn is wound up at a speed of 962 ypm (880 m/min). The properties of the resulting modified yarn are given in Table 5.

EXAMPLE 13

A 150 denier (16.6 tex)-94 filament yarn made from poly(ethylene terephthalate) having a relative viscosity of about 12 is modified as in Example 1 except that the yarn is fed from feed rolls at a speed of 1029 ypm (941 m/min) through the wetting jet and then through 2 interlacing jets having round air-passages of 0.079 cm diameter and round yarn-passages of 0.193 cm diameter. The interlacing jets are operated at 180 psi (1241 kPa) air pressure. The modified yarn is abraded with a Norton abrader A-38 made of 32 "Alundum" in 60–120 grit prior to windup. The windup speed is 1000 ypm (914 m/min). The abrader contact angle and speed are controlled at 20° and 6600 rpm, respectively. The yarn tension downstream of the abrader is adjusted at 373 mN.

The resulting yarn having 14.5 ends per inch (5.7 ends per cm), an average free end length of 2.9 mm (13.1% are greater than 6 mm) and a breaking strength of 72 lbs (320 N) has enhanced spun-like character. It also has a coefficient of variation (% C.V.) of denier of 4.8% as measured under standard conditions at 100 ypm (91 m/min) with an Uster Evenness Tester, type GGP-B21, made by Zellweger Ltd. of Switzerland and a % C.V. of strength of 10.0% as measured under standard conditions with an Uster Automatic Yarn Strength Tester, Model ST 22 57112—3030, made by Zellweger Ltd. of Switzerland. A comparison yarn spun from 3 dpf (0.33 tex/filament) 2.2 inches (5.5 cm) poly(ethylene terephthalate) staple has a % C.V. of denier of 24.4% and a % C.V. of strength of 18.2%.

EXAMPLE 14

Two ends of a 70 denier (7.8 tex)-50 filament yarn of copoly[ethylene terephthalate/5-(sodium sulfo) isophthalate] (98/2 weight ratio) having a relative viscosity of 16 are processed by the procedure described in Example 1 except that the interlace jets are operated at a pressure of 80 psi (552 kPa) pressure of steam in the first jet and air in the second, and the take-up rolls withdraw the modified yarn at 975 ypm (892 m/min). The properties of the resulting yarn are given in Table 5.

EXAMPLE 15

A 500 denier (55.6 tex)-141 filament yarn spun from a poly(ethylene terephthalate) polymer having a relative viscosity of 22 is modified as described in Example 1 but is fed through the jets at a speed of 1039 ypm (950 m/min). Both interlacing jets are operated at an air pressure of 165 psi (1138 kPa). The modified yarn is wound up at a speed of 1000 ypm (914 m/min). The properties of the modified yarn are given in Table 5.

EXAMPLE 16

A 30 denier (3.3 tex)-26 filament nylon 66 yarn made from flake having a relative viscosity of 29 is modified as described in Example 1 but is fed through the jets at a speed of 1025 ypm (937 m/min) while the interlacing jets are operated at an air pressure of 150 psi (1034 kPa) and have a circular yarn passage diameter of 0.158 cm and a round air orifice diameter of 0.079 cm. The yarn is wound up at 1000 ypm (914 m/min). The properties of the resulting yarn are given in Table 5.

EXAMPLE 17

An 840 denier (93.2 tex)-140 filament feed yarn spun from nylon 66 having a relative viscosity of 62 is modified as described in Example 1 except that jets having the structure of the Example 1 wetting jet are used as the interlacing jets and a jet having the structure of the Example 1 interlacing jets is used as the wetting jet. The yarn is fed through the jets at a speed of 1000 ypm (914 m/min) while the first interlacing jet is operated at a steam pressure of 175 psi (1207 kPa) and the second interlacing jet is operated at an air pressure of 175 psi (1207 kPa). The yarn is wound up at 980 ypm (896 m/min). The properties of the resulting yarn are given in Table 5.

EXAMPLE 18

A dry-spun 63 denier (7.0 tex)-36 filament acrylic yarn having a relative viscosity of 26 (measured at 25° C as the ratio of the viscosity of a solution of 0.5 g of polymer [or fiber] dissolved in 10 ml of dimethyl acetamide containing 5% LiCl to the viscosity of the LiCl-containing dimethyl acetamide alone) is modified as described in Example 6, except that 80 psi (552 kPa) pressure of air is applied by both interlacing jets and the speeds of the feed rolls and take-up rolls are 1030 ypm (943 m/min) and 997 ypm (912 m/min), respectively. The properties of the resulting yarn are given in Table 5.

EXAMPLE 19

A 150 denier (16.7 tex)-40 filament cellulose acetate yarn having an intrinsic viscosity of 1.6 determined at 25° C in dimethyl acetamide is modified as in Example 6 except that the speeds of the feed rolls and the take-up rolls are 1034 ypm (946 m/min) and 1019 ypm (932 m/min), respectively, and the air pressure in the interlacing jets is 150 psi (1034 kPa). The properties of the resulting yarn are given in Table 5.

EXAMPLE 20

One end of a 100 denier (11.1 tex)-20 filament yarn of poly(ethylene terephthalate) having a RV of 22 and another end of a 70 denier (7.8 tex)-34 filament yarn of the same polymer having a RV of 12 are combined and modified by the general procedure of Example 1, except that only a single entangling jet is used and the jet is operated at 350 psi (2413 kPa) of air. The yarns are fed to the jet at a speed of 1020 ypm (933 m/min) and wound up at a speed of 1000 ypm (914 m/min).

The resulting effect yarn has 38.6 ends per inch (15.2 ends per cm) and a breaking strength of 151 lbs (672 N) with a coefficient of denier variation of 4.17% (measured as in Example 13). Other properties of this yarn are given in Tables 5 and 6.

In this example, essentially all free ends are produced from the filaments of 12 RV polymer.

EXAMPLE 21

This example exemplifies the preparation of an effect yarn from feed yarns of filaments having two different deniers and RV's and the preparation of a range of fabrics from the effect yarn showning the utility of these yarns in giving superior bulk and covering power over fabric produced from unmodified yarn.

One end of a 100 denier (11.1 tex)-20 filament yarn of copoly[ethylene terephthalate/5-(sodium-solfo) isophthalate] (98/2 weight ratio) having a RV of 15 and another end of a 70 denier (7.8 tex)-34 filament yarn of poly(ethylene terephthalate) having a RV of 11 are combined and modified by the general procedure of Example 20 except that the jet is operated at 300 psi (2068 kPa) of $N_2$. The yarns are fed to the jet at a speed of 1020 ypm (933 m/min) and a wind-up at a speed of 1000 ypm (914 m/min). The resulting yarn properties are given in Tables 5 and 6.

The effect yarn of this example is knitted into 18 cut Ponte de Roma fabric. This is finished by Jawatex scour at 180° F (82° C) followed by heat-setting at 350° F (177° C) for 30 seconds at 55.5 inches (141 cm) width with 6% overfeed. The fabric is dyed in a Hisaki jet dyer at 250° F (121° C) under standard conditions for disperse-dyeable polyester and is dried and heat set in one step at 365° F (185° C) at 50 inches (126 cm) width with 7% overfeed. The fabric has a weight of 8.5 oz/yd$^2$ (288 g/m$^2$) and bulk of 3.8 cc/g. Air permeability is 275 ft$^3$/min/ft$^2$ (84 m$^2$/min/m$^2$). Pilling resistance of the fabric as determined by the Random Tumble Pill Test (ASTM D-1375) is excellent, ratings of 4.0, 3.8, 4.5 are obtained after 10, 20 and 30 minutes of tumbling. The fabric has a warm spun-like hand.

The yarn of this example is also converted into 28-cut La Coste and plain jersey fabrics. The former is knit to 4.3 oz/yd$^2$ (146 g/m$^2$) steamed weight, the latter to 3.5 oz/yd$^2$ (119 g/m$^2$) boiled-off weight. The La Coste is finished by Jawatex scouring at 180° F (82° C), jet scouring and pressure dyeing at 250° F (121° C) under standard conditions for disperse-dyeable polyester, steam-calendering and heat-setting at 350° F (177° C) for 30 seconds at 74 inches (188 cm) width and 5% overfeed. The single jersey is finished by scouring and bleaching under standard conditions used for polyester followed by drying at wet width at 250° F (121° C) and heat setting at 350° F (177° C) for 30 seconds at 59 inches (150 cm) and 8% over feed.

Fabric properties are:

| | Weight | | Bulk | Air Permeability | % Light |
|---|---|---|---|---|---|
| | g/m$^2$ | oz/yd$^2$ | cc/g | m$^3$/min/m$^2$ | Transmission |
| La Coste | 156 | 4.6 | 6.9 | 230 | 10.2 |
| Jersey | 112 | 3.3 | 5.7 | 160 | 16.4 |

To demonstrate the covering power as measured by % light transmission and the bulk of fabric prepared from the effect yarns of this example, the La Coste fabric was compared to other 28-cut La Coste fabrics prepared from 140 denier (15.5 tex)-68 filament unmodified yarn and a 177 denier (19.6 tex) (30/1 cc) poly(ethylene terephthalate)/cotton (65/35) spun yarn:

| Yarn Type | Weight oz/yd$^2$ (g/m$^2$) | Bulk cc/g | Air Permeability m$^3$/min/m$^2$ | % Light Transmission |
|---|---|---|---|---|
| Unmodified | 5.3(180) | 4.3 | 340 | 15.0 |
| Effect | 4.6(156) | 6.9 | 230 | 10.2 |
| Spun | 4.6(156) | 6.2 | 150 | 6.6 |

The fabric made from the effect yarn has substantially higher bulk and covering power than that prepared from the unmodified yarn even though the latter contains much more yarn (greater weight). The effect yarn fabric is almost equivalent to a fabric prepared from a commercial spun yarn. In addition, the fabric uniformity is superior to that of fabric prepared from spun yarn because of its superior denier uniformity.

EXAMPLE 22

This example exemplifies the preparation of an effect yarn prepared from feed yarns of filaments having the same RV but mixed dpf. The feed yarn in this example is spun side-by-side, the low dpf from one spinneret and the high dpf from another. The two ends are combined on the spinning machine and wound up as a single bundle.

A co-spun 104 denier (11.5 tex)-13 filament/70 denier (7.8 tex)-34 filament yarn of copoly[ethylene terephthalate/5-(sodium-sulfo)isophthalate] (98/2 weight ratio) having an RV of 12 is modified by the general procedure of Example 20 except that the jet is operated at 525 psi (3620 kPa) of $N_2$. The yarn is fed to the jet at a speed of 1011 ypm (924 m/min) and wound up at a speed of 1000 ypm (914) m/min). The properties of the resulting yarn are given in Tables 5 and 6.

EXAMPLE 23

This example exemplifies the use of a single RV, single dpf feed yarn for producing a strong modified yarn with free ends.

Three ends of 150 denier (16.7 tex)-94 filament yarn of poly(ethylene terephthalate) having an RV of 11 are combined and modified by the general procedure of Example 21 except that the jet is operated at 350 psi (2413 kPa) air. The yarns are fed to the jets at a speed of 1020 ypm (933 m/min) and wound up at a speed of 1000 ypm (914 m/min). The properties of the yarn resulting from this treatment are shown in Tables 5 and 6.

EXAMPLE 24

This example exemplies the preparation of an effect yarn from feed yarns of filaments having two different cross sections, and the preparation of a woven fabric demonstrating the superior covering power of the effect yarns.

One end of a 40 denier (4.4 tex)-8 filament yarn of poly(ethylene terephthalate) having an RV of 22, the filaments of which have round cross-sections, and one end of a 40 denier (4.4 tex)-27 filament yarn of copoly-[ethylene terephthalate/5-(sodium sulfo)isophthalate] having an RV of 15, the filaments of which have substantially symmetrical trilobal cross-sections, are combined and modified by the general procedure of Example 21 except that the jet is operated at 325 psi (2241 kPa) of $N_2$. The properties of the resulting yarn are listed in Tables 5 and 6. The yarn is converted into a plain weave fabric. Loom construction is 80 ends per inch (epi) × 68 picks per inch (ppi) [32 ends per cm (e/cm) × 27 picks per cm (p/cm)]. The greige fabric is heat set at 340° F (171° C) for 20 seconds 1 inch (2.5 cm) under width and 2% overfeed, bleached and dried under standard conditions used for polyester. The fabric is given a light singe, and is cold calendered and semi-decated 1 × 1. Finished weight is 1.7 oz/yd$^2$ (57.7 g/m$^2$). The cover of this fabric as measured by % light transmission as compared to that of a commercial poly-(ethylene terephthalate)/cotton (63/35) of similar construction but higher weight is found to be better:

| Fabric | Weight g/m$^2$ | Construction e/cm × p/cm | % Light Transmission |
|---|---|---|---|
| Effect yarn | 57.7 | 35 × 29 | 11.3 |
| Commercial | 74.7 | 35 × 30 | 16.6 |

EXAMPLE 25

This example exemplifies the use of feed yarns of filaments prepared from two different polymer types to produce a strong modified yarn with free ends.

One end of a 100 denier (11.1 tex)-20 filament yarn of poly(ethylene terephthalate) having a RV of 22 and one end of a 55 denier (6.1 tex)-24 filament yarn of cellulose acetate (Acele acetate, Type C) are combined and modified by the general procedure of Example 1. Both jets are operated at 170 psi (1172 kPa) and the yarns are fed at 1030 ypm (942 m/min) and wound up at 1000 ypm (914 m/min). The properties of the resulting yarn are given in Tables 5 and 6.

TABLE 5

| Example | Yarn Twist | Node Twist | Interval Structure | Interval Length mm Average | Interval Length mm Range | Node Length mm Average | Node Length mm Range | % Nodes | Retentivity % | Rothschild Mean | Rothschild O's % | Rothschild ≦3 mm % | Rothschild >15 mm % |
|---|---|---|---|---|---|---|---|---|---|---|---|---|---|
| 1 | 0 | 0 | AS[1] | 5.7 | 2-11 | 4.6 | 1-20 | 45 | 96 | 4.0 | 1.3 | 59 | 0 |
| 2 | 0 | 0 | " | 6.3 | 1-11 | 4.0 | <1-9 | 39 | — | | | | |
| 3 | 0 | 0 | " | 6.6 | 2-25 | 4.8 | 1-10 | 42 | 77 | 5.5 | 1.6 | 42 | 2.3 |
| 5 | 0 | 0 | " | 7.2 | 2-28 | 3.5 | <1-9 | 32 | 95 | 5.7 | 0.0 | 41 | 1.3 |
| 6 | 0 | 0 | " | 5.8 | 2-12 | 4.9 | 1-14 | 46 | 87 | | | | |
| 7 | 0 | 0 | " | 6.4 | 3-10 | 4.3 | 1-13 | 40 | 82 | 5.0 | 0.3 | 42 | 0.3 |
| 8 | 0 | 0 | " | 6.6 | — | 3.7 | — | 36 | — | | | | |
| 9 | 0 | 0 | " | 8.0 | 5-14 | 5.0 | 1-11 | 38 | 98 | | | | |
| 10 A | 0 | 0 | " | 5.7 | 2-24 | 6.4 | 1-14 | 52 | 82 | 3.4 | 12.3 | 65 | 0 |
| 10 B | 0 | 0 | " | 7.7 | 2-28 | 3.5 | <1-9 | 31 | 100 | 4.4 | 0.7 | 48 | 0.3 |
| 11 | 0 | 0 | " | 3.7 | 2-6 | 6.0 | 1-10 | 62 | 96 | 3.0 | 5.7 | 62 | 0 |
| 12 | 0 | 0 | " | 5.2 | 1-8 | 4.9 | 1-10 | 49 | 93 | 3.9 | 2.6 | 50 | 0 |
| 13 | 0 | 0 | " | 7.6 | 1-21 | 3.5 | 1-8 | 31 | 100 | | | | |
| 14 | 0 | 0 | " | 4.7 | 3-11 | 4.8 | 2-8 | 51 | 79 | 3.7 | 4.8 | 57 | 0 |
| 15 | 0 | 0 | " | 5.4 | 3-12 | 4.1 | 1-9 | 43 | 88 | 3.5 | 2.0 | 64 | 0.3 |
| 16 | 0 | 0 | " | 5.5 | 4-10 | 2.6 | 1-8 | 32 | 87 | 4.6 | 6.0 | 42 | 0 |
| 17 | 0 | 0 | " | 7.3 | 2-45 | 6.3 | 2-13 | 46 | 81 | 4.5 | 1.6 | 55 | 1.0 |
| 18 | 0 | 0 | " | 5.6 | 1-12 | 4.5 | 1-9 | 44 | 88 | | | | |
| 19 | 0 | 0 | " | 5.9 | 1-16 | 3.3 | <1-10 | 36 | 100 | 4.7 | 0.0 | 46 | 0 |
| 20 | 0 | 0 | " | 4.3 | 1-11 | 2.1 | 1-5 | 35 | 90 | 4.9 | 0 | 40 | 0 |
| 21 | 0 | 0 | " | 4.1 | 1-13 | 2.1 | 1-4 | 34 | 100 | | | | |
| 22 | 0 | 0 | "6.0 | 2-25 | 2.8 | 1-7 | 32 | 93 | | | | | |
| 23 | 0 | 0 | " | 5.0 | 2-16 | 2.5 | 1-5 | 33 | 95 | | | | |
| 24 | 0 | 0 | " | 4.8 | 1-21 | 3.1 | 1-7 | 39 | 89 | | | | |

TABLE 5-continued

| Example | Yarn Twist | Node Twist | Interval Structure | Interval Length mm Average | Interval Length mm Range | Node Length mm Average | Node Length mm Range | % Nodes | Retentivity % | Rothschild Mean | O's % | ≦3 mm % | >15 mm % |
|---|---|---|---|---|---|---|---|---|---|---|---|---|---|
| 25 | 0 | 0 | " | 4.6 | 1–10 | 3.2 | 1–8 | 41 | 80 | | | | |

[1]AS = asymmetrically splayed

TABLE 6

| Example | Breaking Strength Lbs | Breaking Strength N | Ends/ cm*** | Free End Length mm Avg | Free End Length mm %>6 | Denier Uniformity**** % CV |
|---|---|---|---|---|---|---|
| 20 | 151 | 672 | 15* | 1.4 | 0.8 | 4.1 |
| 21 | 121 | 538 | 11** | 1.7 | 0.3 | 2.4 |
| 22 | 54 | 271 | 10** | 1.6 | 2.6 | 3.4 |
| 23 | 159 | 107 | 27** | 2.0 | 1.6 | 2.8 |
| 24 | 50 | 222 | 6** | 1.4 | 1.3 | — |
| 25 | 111 | 494 | 16** | 1.6 | 1.0 | 7.5 |

*Determined using Test I
**Determined using Test II
***Rounded off to nearest whole number
****Measured as described in Example 13

So far, this detailed description has referred to application of the invention to yarns of the type that are useful in making woven, knitted or other fabrics, in other words to drawn yarns. As indicated in the following Example, however, the invention is also applicable to partially oriented yarns, such as are available commercially, being obtained by melt spinnning at relatively high speeds, preferably in excess of 2500 m/min, and are used commercially as feed yarns for simultaneous draw-texturing. Such yarns include polyester yarns having a birefringence of about 0.025 to about 0.05, and nylon yarns having a birefringence of about 0.04 to about 0.05.

EXAMPLE 26

A 255 denier (28.1 tex)-68 filament draw-texturing feed yarn of poly(ethylene terephthalate) of 22 RV having a birefringence of 0.040 (measured as in British Pat. No. 1,406,810, pages 5 and 6) is modified as described in Example 1, except that the wetting jet has a round yarn entrance orifice of 0.193 cm diameter with round air (water) entrance orifices of 0.079 cm diameter, each interlacing jet has an oval yarn entrance hole of 0.157 cm width and 0.254 cm length with 0.097 cm diameter round air entrance orifices and is operated at 180 psi (1241 kPa) pressure of air, and that the takeup speed is 975 ypm (892 m/min).

The resulting modified yarn has 34% of its length entangled in nodes averaging 3.9 mm in length and having a retentivity of 94%. The average interval length is 7.7 mm.

This modified yarn is draw-textured on a commercial Leesona 570 false-twist texturing machine, modified for simultaneous drawing and texturing as described in Piazza & Reese U.S. Pat. No. 3,722,872, being fed at a speed of 90 ypm (82 m/min), drawn at a draw ratio of 1.57×, with a first heater at a temperature of 420° F (216° C) and a spindle speed of 195,000 rpm to give a yarn twist level of 60 tpi (23.6 turns/cm), set using a second heater at a temperature of 400° F (204° C) with 15% overfeed, and then wound up using an underfeed of 4%.

The draw-textured modified yarn of this Example and, for comparison, some draw-textured unmodified draw-texturing feed yarn for this Example are knitted into 18-cut (7.1 needles/cm) Ponte de Roma fabrics. These are finished by Jawatex scouring at 208° F (98° C) at open width, and dyed in a Hisaki Jet Dyer using standard conditions for disperse-dyeable polyester yarn, and heat set at 350° F (177° C) for 45 sec. Finished weights are 264 g/m² for the modified yarn fabric and 258 g/m² for the comparison fabric. Both fabrics have a similar bulk of 3.8 cc/g. The test fabric has a drier tactility and a more spun-like appearance.

As shown in this Example, the draw-textured yarn prepared from modified draw-texturing feed yarn is useful in preparing fabrics having a similar bulk but a more spun-like tactility and appearance than those from draw-textured yarn prepared from the unmodified draw-texturing feed yarn, because of the presence of the nodes.

It is important to carry out the draw-texturing simultaneously. If the modified draw-texturing feed yarn is merely drawn, or drawn and textured sequentially, it is difficult to retain the nodes.

It will be understood that effect yarns with free ends can also be prepared using draw-texturing feed yarns. The free ends are preferably created by stretch-breaking during the draw-texturing operation. For this purpose, the draw-texturing feed yarns preferably contain a mixture of component yarns having differing break elongations.

When the invention is applied to partially oriented yarns that are subsequently destined for simultaneous draw-texturing, the levels of entanglement and retentivity can be lower than indicated above for drawn yarn. Such partially oriented yarns, however, preferably have nodes comprising an average of at least 10% of the yarn length and a retentivity of at least about 50%. The subsequent simultaneous draw-texturing introduces more retentivity in the final draw-textured yarns.

Although the invention has been described in considerable detail in the foregoing, it is to be understood that such detail is solely for the purpose of illustration and that variations can be made therein by those skilled in the art without departing from the spirit and scope of the invention.

What is claimed is:

1. A yarn of organic fibers which has zero twist and random lengths of tightly entangled fibers as nodes having substantially zero twist, the nodes comprising an average of about 20%-70% of the yarn length, and having a retentivity of at least 75% and alternating with random lengths of substantially unentangled asymmetrically splayed fibers in intervals having an average length of about 3–12 mm.

2. The yarn of claim 1 having a retentivity of at least 95%.

3. The yarn of claim 1 wherein the nodes having zero twist as produced have a substantially braided appearance.

4. The yarn of claim 1 having 30–60% nodes in the yarn length.

5. The yarn of claim 1 wherein the nodes have an average length of 1–8 mm.

6. The yarn of claim 1 wherein the intervals have an average length of 3–8 mm.

7. The yarn of claim 1 wherein the fibers have different deniers.

8. The yarn of claim 1 wherein the organic fibers are fibers of a rayon, homo or copolymer of a nylon, aramide, polyester, acrylic polymer, polyolefin, or mixtures of any of them.

9. The yarn of claim 8 wherein the organic fibers are fibers of a polyester.

10. The yarn of claim 8 having a denier of up to about 800.

11. The yarn of claim 10 having a denier of up to about 600.

12. The yarn of claim 1 wherein the organic fibers are bicomponent fibers.

13. The yarn of claim 1 wherein the organic fibers are bicomponent and monocomponent fibers.

14. A yarn wherein a fraction of the fibers in the yarn of claim 13 is broken.

15. The yarn of claim 1 wherein the organic fibers are splittable bicomponent fibers.

16. A yarn wherein a fraction of the fibers in the yarn of claim 15 is broken.

17. The yarn of claim 1 wherein the fibers have mixed shrinkage.

18. A yarn wherein a fraction of the fibers in the yarn of claim 17 is broken.

19. The yarn of claim 1 wherein the fibers have a modified cross section.

20. The yarn of claim 1 which contains at least 10 fibers wherein the fibers in the yarn have an average dpf of less than 8.

21. The yarn of claim 1 wherein the fibers have mixed cross sections.

22. The yarn of claim 1 wherein a fraction of the fibers in the yarn is broken.

23. The yarn of claim 22 which contains at least two different fibers, each of which is composed of a different organic polymer.

24. The yarn of claim 22 which contains fibers of an organic polymer having at least two different viscosities.

25. The yarn of claim 22 which contains fibers having different deniers per filament.

26. The yarn of claim 22 having at least 20 fibers wherein the fibers in the yarn have an average dpf of less than 8.

27. A fabric of the yarn of claim 22.

28. The yarn of claim 1 having continuous filaments.

29. A fabric of the yarn of claim 1.

30. The yarn of claim 1 wherein the organic fibers are prepared by melt spinning at a withdrawal speed in excess of 2500 m/min.

31. The yarn of claim 30, wherein the nodes comprise an average of at least about 10% of the yarn length and a retentivity of at least about 50%.

32. The yarn of claim 1 wherein the organic fibers are fibers of a polyester having a birefringence of about 0.025 to about 0.05.

33. The yarn of claim 32, wherein the nodes comprise an average of at least about 10% of the yarn length and a retentivity of at least about 50%.

* * * * *